US011472183B2

(12) United States Patent
Tomiya

(10) Patent No.: US 11,472,183 B2
(45) Date of Patent: Oct. 18, 2022

(54) LIQUID DISCHARGE HEAD, DISCHARGE DEVICE, AND LIQUID DISCHARGE APPARATUS

(71) Applicant: Ricoh Company, Ltd., Tokyo (JP)

(72) Inventor: Toichiro Tomiya, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/192,966

(22) Filed: Mar. 5, 2021

(65) Prior Publication Data

US 2021/0370676 A1 Dec. 2, 2021

(30) Foreign Application Priority Data

May 26, 2020 (JP) ..... JP2020-091442

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2002/14258* (2013.01)

(58) Field of Classification Search
None
See application file for complete search history.

(56) References Cited

U.S. PATENT DOCUMENTS

2007/0104554 A1* 5/2007 Ishino ..... F16B 29/00 411/182
2008/0239019 A1* 10/2008 Okazawa ..... B41J 2/14274 347/70

FOREIGN PATENT DOCUMENTS

| | | |
|---|---|---|
| JP | 10-296984 | 11/1998 |
| JP | 2002-361877 | 12/2002 |
| JP | 2003-089204 | 3/2003 |

* cited by examiner

*Primary Examiner* — Erica S Lin
(74) *Attorney, Agent, or Firm* — Xsensus LLP

(57) ABSTRACT

A liquid discharge head configured to discharge a liquid, the liquid discharge head includes a thin film member including a first layer, a second layer bonded with the first layer, and a through hole penetrating through the first layer and the second layer. The through hole includes the first opening in the first layer and the second opening in the second layer.

13 Claims, 13 Drawing Sheets

LIQUID DISCHARGE HEAD, DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-091442, filed on May 26, 2020, in the Japan Patent Office, the entire disclosures of which is hereby incorporated by reference herein.

BACKGROUND

Technical Field

Aspects of the present disclosure relate to a liquid discharge head, a discharge device, and a liquid discharge apparatus.

Related Art

A liquid discharge head to discharge a liquid includes a nozzle plate, pressure chambers (individual chambers), diaphragms, and the like. The nozzle plate, pressure chambers, diaphragms, and the like are sequentially stacked and bonded with adhesive to form the liquid discharge head. Nozzles are formed in the nozzle plate. The pressure chambers communicate with the nozzles. The diaphragm forms a wall of the pressure chambers.

A reference hole for assembly of the diaphragm is made smaller than a guide pin for assembly, and the guide pin is press-fitted into the reference hole for assembly.

SUMMARY

In an aspect of this disclosure, a liquid discharge head is configured to discharge a liquid, the liquid discharge head includes a thin film member including a first layer, a second layer bonded with the first layer, and a through hole penetrating through the first layer and the second layer. The through hole includes the first opening in the first layer and the second opening in the second layer.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
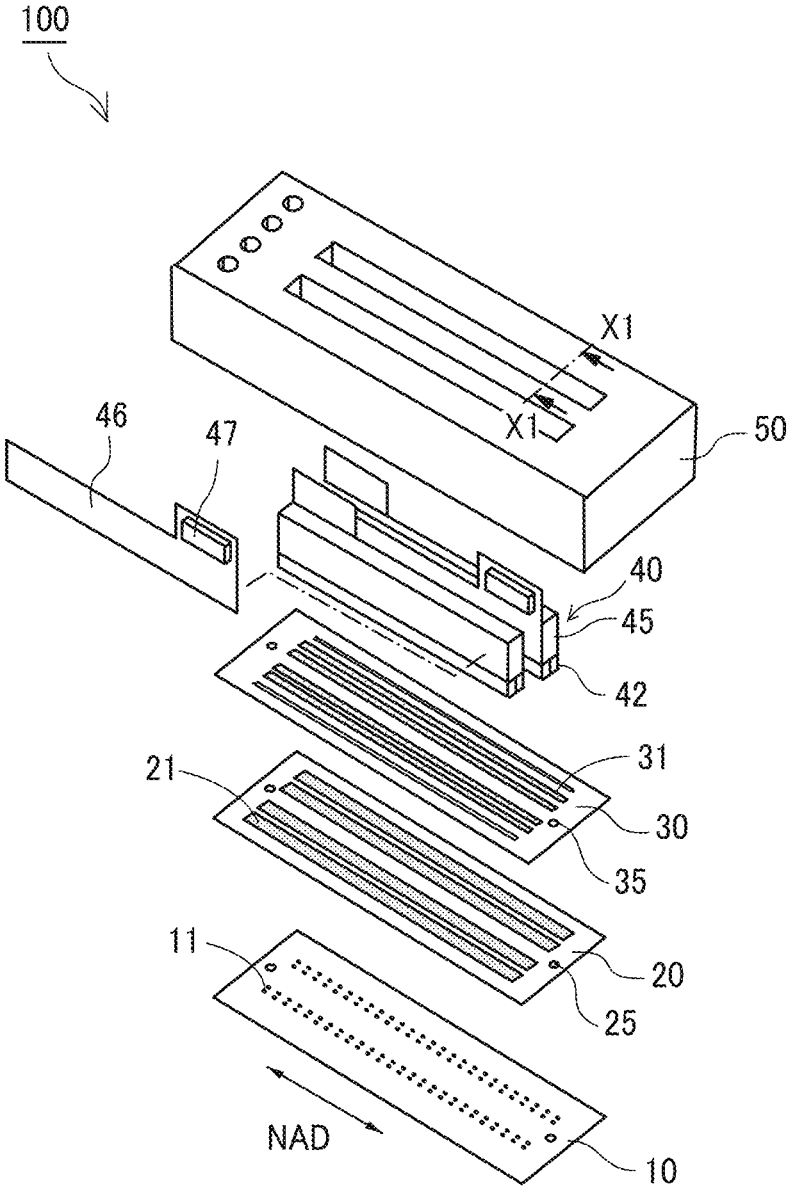
FIG. 1 is an exploded perspective view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Embodiments of the present disclosure are described below with reference to the attached drawings. A first embodiment of the present disclosure is described below with reference to FIGS. 1 to 3.

FIG. 1 is exploded perspective view a liquid discharge head 100 according to the first embodiment of the present disclosure.

Figure 2:
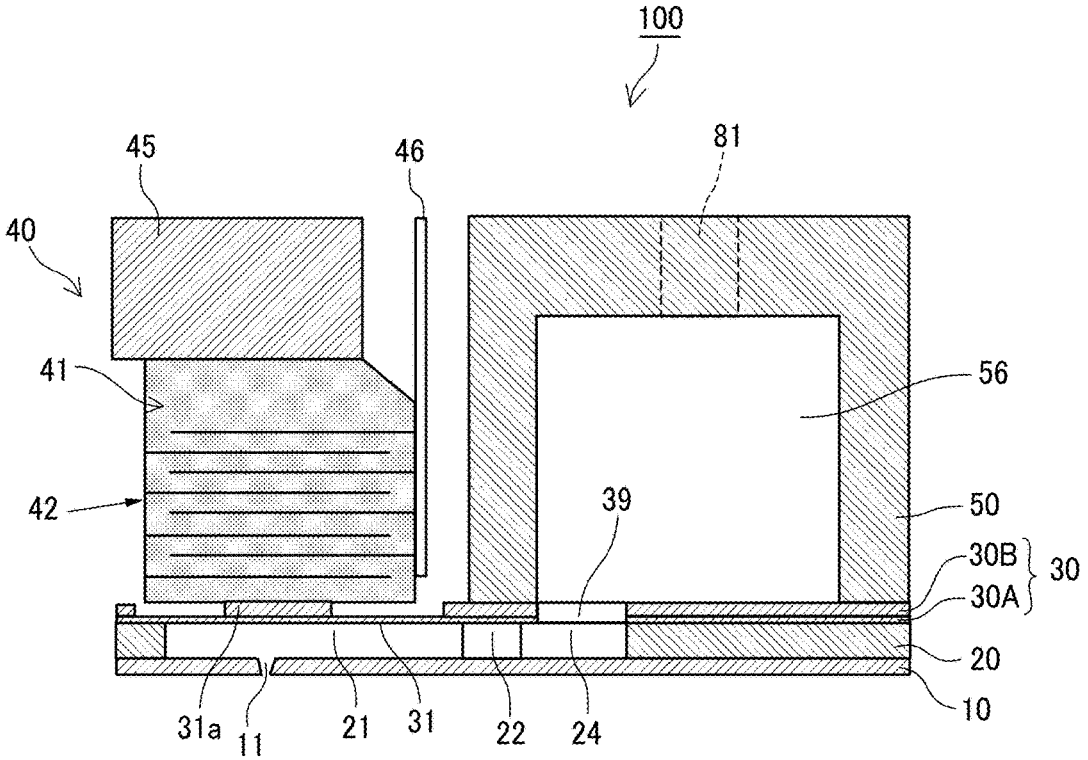
FIG. 2 is a cross-sectional view of the liquid discharge head along a direction perpendicular to a nozzle array direction along a line A-A in FIG. 1.

FIG. 2 is a cross-sectional view of the liquid discharge head 100 along a line "X1-X1" in a direction perpendicular to a nozzle array direction indicated by arrow "NAD" in which nozzles 11 are arrayed in row.

Figure 3:
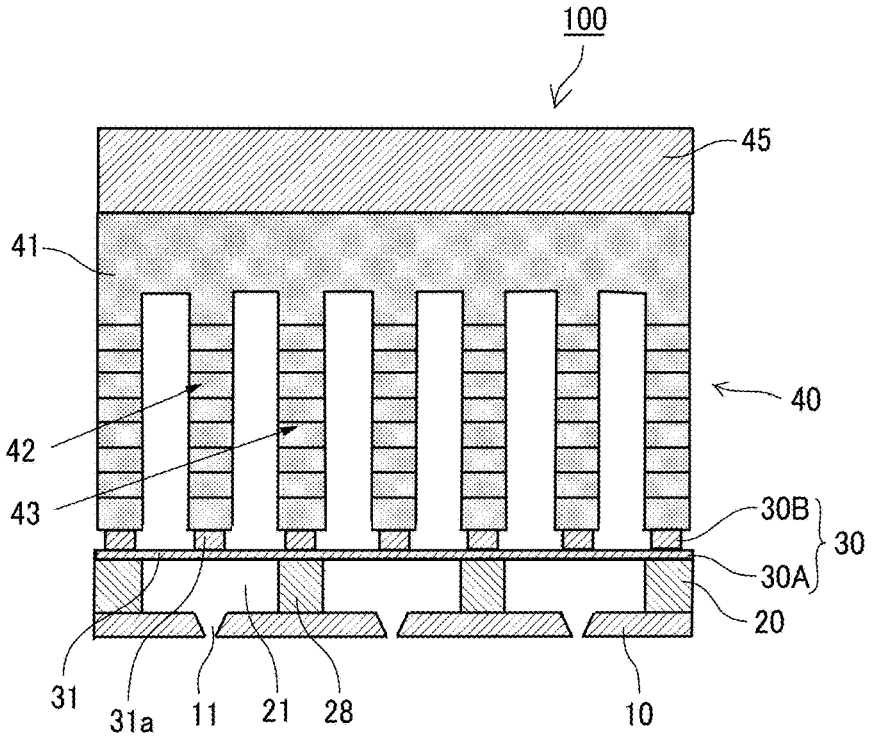
FIG. 3 is a cross-sectional view of a portion of the liquid discharge head of FIG. 1 along a nozzle array direction.

FIG. 3 is a schematic cross-sectional view of a portion of the liquid discharge head 100 of FIG. 1 along the nozzle array direction NAD.

The liquid discharge head 100 includes a nozzle plate 10, a channel plate 20, and a diaphragm 30 that are laminated one on another and bonded to each other. The diaphragm 30 serves as a wall member. Hereinafter, the liquid discharge head 100 is simply referred to as a "head 100."

The head 100 further includes a piezoelectric actuator 40 and a common channel member 50. The piezoelectric actuator 40 displaces a vibration region 31 of the diaphragm 30. The vibration region 31 is also referred to as a diaphragm region or vibration plate. The common channel member 50 also serves as a frame of the head 100.

The nozzle plate 10 includes a plurality of nozzle arrays in each of which a plurality of nozzles 11 are arrayed in the nozzle array direction NAD. In FIG. 1, the nozzle plate 10 includes four rows of the nozzle arrays.

The channel plate 20 includes a plurality of pressure chambers 21, one or more individual supply channels 22, and one of more intermediate supply channels 24. The plurality of pressure chambers 21 respectively communicates with the plurality of nozzles 11. The one or more individual supply channels 22 also serve as fluid restrictors and communicate with the plurality of pressure chambers 21. One or more of the intermediate supply channels 24 respectively communicate with one or more of the individual supply channels 22. Adjacent pressure chambers 21 are separated by a partition wall 28 (see FIG. 3).

The diaphragm 30 includes a plurality of restorably displaceable vibration regions 31 that form walls of the pressure chambers 21 in the channel plate 20. Here, the diaphragm 30 has a two-layer structure and includes a first layer 30A forming a thin portion and a second layer 30B forming a thick portion in this order from a side facing the channel plate 20. Note that the structure of the diaphragm 30 is not limited to such a two-layer structure but may be any suitable layer structure.

The displaceable vibration region 31 is formed in a portion corresponding to the pressure chamber 21 in the first layer 30A that is a thin portion. The vibration region 31 includes an island-shaped convex portion 31*a* that is a thick portion bonded to the piezoelectric actuator 40 in the second layer 30B. The island-shaped convex portion 31*a* is formed by a part of the second layer 30B as illustrated in FIG. 3.

The head 1 includes the piezoelectric actuator 40 on an upper surface of the diaphragm 30 opposite a lower surface of diaphragm 30 facing the pressure chamber 21. The piezoelectric actuator 40 includes a piezoelectric element 42 (electromechanical transducer element) serving as a driving device to deform the vibration region 31 of the diaphragm 30. The driving device is also referred to as an actuator device or a pressure generation device.

In the piezoelectric actuator 40, a piezoelectric member 41 bonded on a base 45 is grooved by half-cut dicing, to form a desired number of columnar piezoelectric elements 42 and supports 43 at predetermined intervals in a comb shape in the nozzle array direction NAD.

The piezoelectric element 42 is a piezoelectric element that displaces the vibration region 31 when a drive voltage is applied to the piezoelectric element 42. The support 43 is a piezoelectric element that supports the partition wall 28 between the pressure chambers 21. The drive voltage is not applied to the support 43.

The piezoelectric element 42 is bonded to the convex portion 31*a* in the vibration region 31 of the diaphragm 30 with an adhesive. The supports 43 are bonded to portions of the diaphragm 30 corresponding to the partition walls 28 with an adhesive.

Thus, the piezoelectric element 42 is bonded to the diaphragm 30. The first layer 30A of the diaphragm 30 (thin film member) faces the pressure chamber 21, and the second layer 30B of the diaphragm 30 (thin film member) is bonded to the piezoelectric element 42 (see FIG. 3).

The piezoelectric member 41 includes piezoelectric layers and internal electrodes alternately laminated on each other. Each internal electrode is led out to an end surface of the piezoelectric member 41 and connected to an external electrode (end surface electrode). The external electrode is connected with a flexible wiring 46 (see FIG. 2). A driver IC 47 is mounted on the flexible wiring 46 (see FIG. 1).

The common channel member 50 defines a common supply channel 56. The common supply channel 56 communicates with the intermediate supply channel 24 via an opening 39 in the diaphragm 30. The common channel member 50 includes a supply port 81 (see FIG. 2) to supply a liquid to the common supply channel 56 from an exterior of the head 100.

In the head 100, for example, the voltage to be applied to the piezoelectric element 42 is lowered from a reference potential (intermediate potential) so that the piezoelectric element 42 contracts to pull the vibration region 31 of the diaphragm 30 to increase the volume of the pressure chamber 21. As a result, liquid flows into the pressure chamber 21.

Then, the voltage to be applied to the piezoelectric element 42 is increased to expand the piezoelectric element 42 in a direction of lamination. The vibration region 31 of the diaphragm 30 is deformed in a direction toward the nozzle 11 to reduce the volume of the pressure chamber 21. Thus, the liquid in the pressure chamber 21 is pressurized and discharged from the nozzle 11 of the head 100.

Next, an adhesive bonding between the channel plate 20 and the diaphragm 30 is described with reference to FIG. 4.

Figure 4:
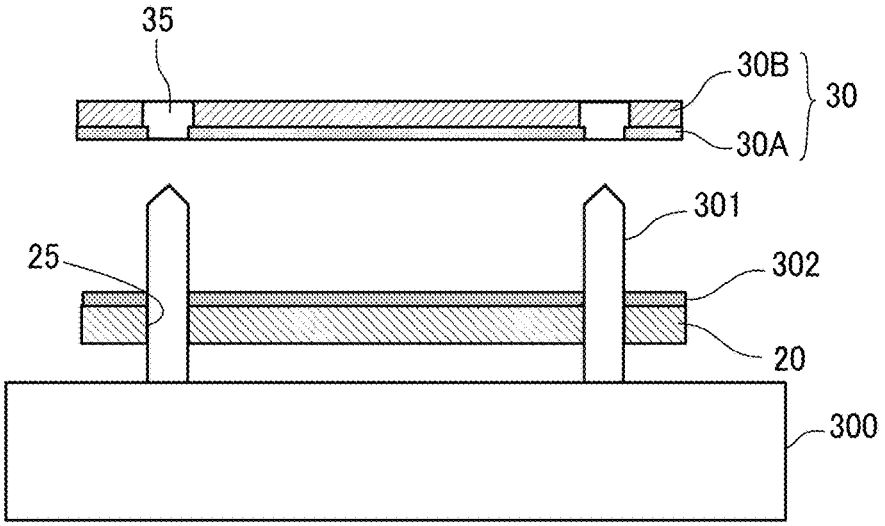
FIG. 4 is a schematic cross-sectional view of a channel plate and a diaphragm according to the first embodiment along the nozzle array direction.

FIG. 4 is a schematic cross-sectional view of the channel plate 20 and the diaphragm 30 according to the first embodiment along the nozzle array direction NAD.

As illustrated in FIG. 1, the channel plate 20 includes positioning through holes 25 at both ends of the channel plate 20 in the nozzle array direction NAD. Further, the diaphragm 30 includes positioning through holes 35 on both ends of the diaphragm 30 in the nozzle array direction NAD.

When the channel plate 20 and the diaphragm 30 are bonded with an adhesive, the channel plate 20, to which the adhesive 302 is applied, is pushed into positioning pins 301 of a jig 300 so that positioning pins 301 passes through the positioning through holes 25 of the channel plate 20. Thus, the channel plate 20 is set to the jig 300.

Then, the diaphragm 30 is inserted into the positioning pins 301 of the jig 300 so that the positioning pins 301 of the jig 300 passes through the positioning through holes 35 of the diaphragm 30. Thus, the diaphragm 30 contact with and is overlapped with the channel plate 20, and the first layer 30A of the diaphragm 30 as the bonding surface is thus bonded with the channel plate 20 with the adhesive 302.

Next, the positioning through holes 35 of the diaphragm 30 as the thin film member according to the first embodiment of the present disclosure is described with reference to FIGS. 5 and 6.

Figure 5:
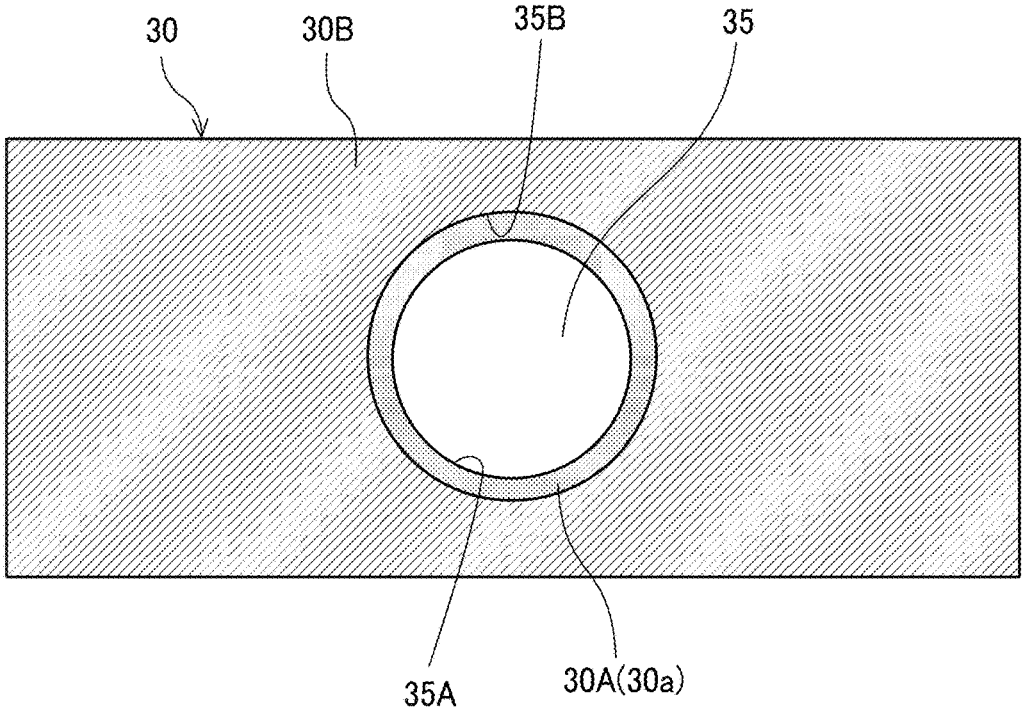
FIG. 5 is a schematic plan view of a portion of a positioning through hole of the diaphragm.

FIG. 5 is a schematic plan view of a portion of the positioning through hole 35 of the diaphragm 30.

Figure 6:
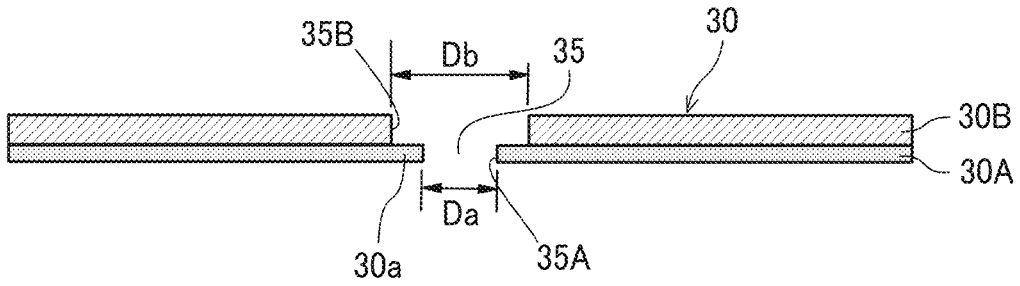
FIG. 6 is a schematic cross-sectional view of the positioning through hole in the diaphragm according to the first embodiment.

FIG. 6 is a schematic cross-sectional view of the positioning through holes 35 in the diaphragm 30 according to the first embodiment.

As described above, the diaphragm 30 includes the first layer 30A and the second layer 30B. The diaphragm 30 is formed by deposition of the first layer 30A constituting a thin film member (vibration region 31) by nickel electroforming, and then the second layer 30B is laminated on the first layer 30A, for example. A resist pattern is film-formed on the first layer 30A in a portion other than the second layer 30B.

Thus, the diaphragm 30 according to the first embodiment includes the first layer 30A as the thin film member and the second layer 30B that forms a single body. However, the diaphragm 30 according to the first embodiment may include different types of layers such that a metal layer to become the first layer 30A and a resin layer to become the second layer 30B are bonded with each other.

Further, the diaphragm 30 according to the first embodiment includes the first layer 30A having a thickness of 3 μm and the second layer 30B having a thickness of 7 μm. However, the thickness of the first layer 30A and the second layer 30B are not limited to the above-described thickness and may be any other thickness. Thus, a thickness of the first layer 30A is smaller than a thickness of the second layer 30B.

The first layer 30A includes a first opening 35A as a through hole forming a part of the positioning through hole 35. The second layer 30B includes a second opening 35B as a through hole forming a part of the positioning through hole 35.

A diameter Db of the second opening 35B is made larger than a diameter Da of the first opening 35A. Further, a size of the second opening 35B of the second layer 30B is made larger than a size of the first opening 35A of the first layer 30A. Thus, the second layer 30B includes a second opening 35B having a size larger than the first opening 35A that forms the positioning through hole 35.

Next, a function of the diaphragm 30 according to the first embodiment is described with reference also to FIG. 7.

Figure 7:
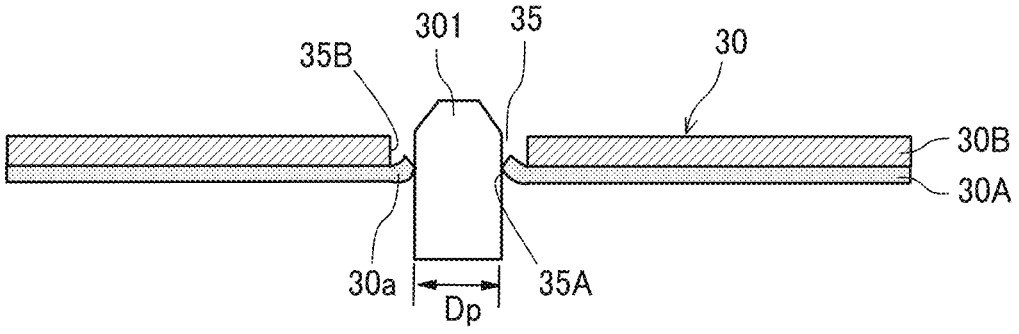
FIG. 7 is a schematic cross-sectional view of the diaphragm illustrating an effect of the diaphragm according to the first embodiment.

FIG. 7 is a schematic cross-sectional view of the diaphragm 30 illustrating an effect of the diaphragm 30 according to the first embodiment.

Here, as illustrated in FIG. 7, the jig 300 includes a positioning pin 301 having a diameter Dp slightly larger than a diameter Da (see FIG. 6) of the first opening 35A and smaller than a diameter Db (see FIG. 6) of the second opening 35B.

The first layer 30A includes a peripheral portion 30*a* in a periphery of the first opening 35A of the first layer 30A.

When the positioning pin 301 is inserted into the positioning through hole 35 of the diaphragm 30, the positioning pin 301 fits into the peripheral portion 30*a* of the first opening 35A of the first layer 30A. Thus, the second layer 30B is deformed toward the second opening 35B side as illustrated in FIG. 7.

At this time, since the second opening 35B of the second layer 30B is larger than the first opening 35A of the first layer 30A, the force generated by a deformation of the peripheral portion 30*a* of the first opening 35A of the first layer 30A does not affect pm the second layer 30B. Thus, the diaphragm 30 can be positioned while reducing the deformation of the second layer 30B. Thus, the diaphragm 30 according to the first embodiment can improve a positioning accuracy of the diaphragm 30.

Thus, the peripheral portion 30*a* is deformable inside the second opening 35B of the second layer 30B, and the peripheral portion 30*a* does not protrude from the first surface (upper surface in FIG. 8C) of the second layer 30B opposite to a second surface (lower surface in FIG. 8C) of the second layer 30B bonded to the first layer 30A when the peripheral portion 30*a* is deformed.

Further, the thin portion (vibration region 31) that is a vibrating portion of the diaphragm 30 is adopted as the first layer 30A in which the first opening 35A is formed. Thus, a function of vibration (deformability) of the thin portion (vibration region 31) can be applied to deformation of the thin portion (vibration region 31) when the positioning pin is inserted into the positioning through hole 35.

The diaphragm 30 according to the first embodiment includes the first layer 30A and the second layer 30B. A manufacturing method of the head 100 includes following processes. The first opening 35A is formed in the first layer 30A. The first opening 35A forms the positioning through hole 35.

Next, an adhesive 302 is applied to at least one of the diaphragm 30 and the channel plate 20 as the process of the manufacturing method. The diaphragm 30 serves as a thin film member and includes the first opening 35A and the second opening 35B. The second opening 35B is larger than the first opening 35A that forms the positioning through hole 35. The channel plate 20 is boned to the diaphragm 30. The positioning pin 301 inserted into the positioning through hole 25 of the channel plate 20 as the process of the manufacturing method (see FIG. 4).

Further, the positioning pin 301 is inserted into the positioning through hole 35 of the diaphragm 30 from the first opening 35A side as the process of the manufacturing method (see FIG. 7). Then, the diaphragm 30 and the channel plate 20 are bonded with the adhesive 302 as the process of the manufacturing method.

Figure 8A:
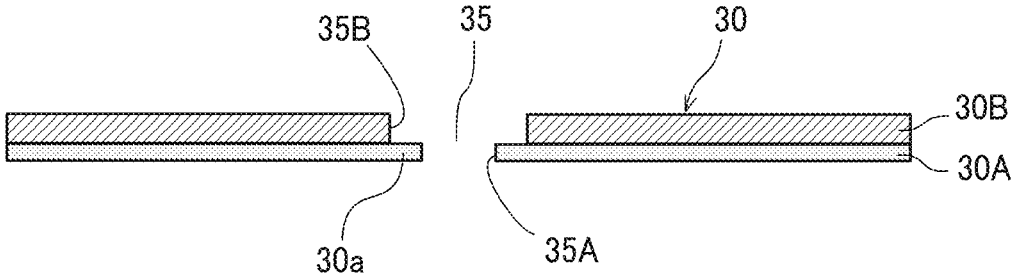
FIGS. 8A to 8C are schematic cross-sectional views of a portion of the positioning through hole of the diaphragm with illustrating an effect of the diaphragm according to a second embodiment of the present disclosure.
Figure 8B:
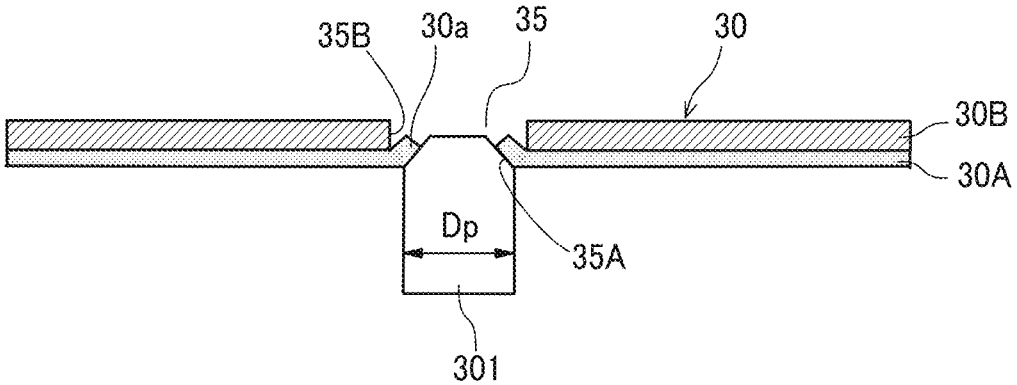
Figure 8C:
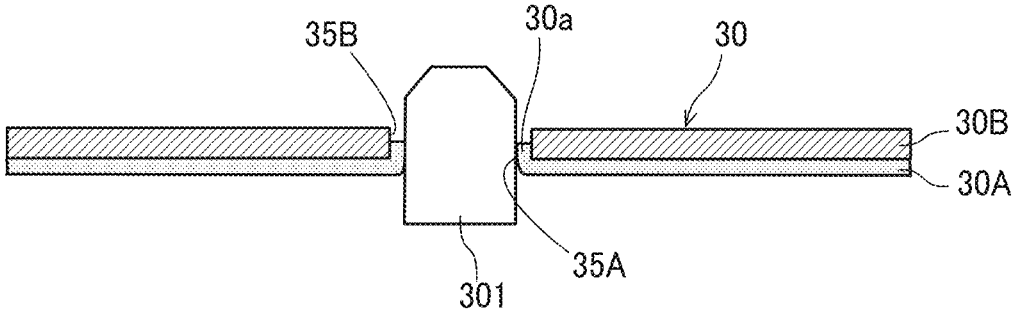

The diaphragm 30 according to a second embodiment of the present disclosure is described with reference to FIGS. 8A to 8C. FIGS. 8A to 8C are schematic cross-sectional views of a portion of the positioning through hole 35 of the diaphragm 30 according to the second embodiment of the present disclosure.

In the diaphragm 30 according to the second embodiment, when the positioning pin 301 is inserted into the positioning through hole 35, a deformed portion of a peripheral portion 30*a* of the first opening 35A of the first layer 30A is sandwiched between a peripheral surface of the positioning pin 301 and the second opening 35B of the second layer 30B to position the positioning pin 301 as illustrated in FIG. 8C.

Thus, as illustrated in FIG. 8A, the diaphragm 30 is used that includes the first opening 35A in the first layer 30A and the second opening 35B in the second layer 30B. The second opening 35B is larger than the first opening 35A. Then, as illustrated in FIG. 8B, the positioning pin 301 is inserted into the positioning through hole 35 of the diaphragm 30 from a side (lower side in FIG. 8B) the first opening 35A of the first layer A.

Along with an insertion of the positioning pin 301 into the positioning through hole 35, the peripheral portion 30*a* of the first opening 35A of the first layer 30A is deformed in an insertion direction (toward an upper direction in FIG. 8B) of the positioning pin 301. The insertion direction of the positioning pin 301 is a direction from the first opening 35A of the first layer 30A toward the second opening 35B of the second layer 30B.

Then, as illustrated in FIG. 8C, the peripheral portion 30*a* of the first opening 35A of the first layer 30A is sandwiched between a peripheral surface of the positioning pin 301 and the second opening 35B of the second layer 30B.

In such a way as described above, the peripheral portion 30*a* of the first opening 35A of the first layer 30A is sandwiched between the peripheral surface of the positioning pin 301 and the second opening 35B of the second layer 30B. Thus, the diaphragm 30 according to the second embodiment can reduce a positional deviation of the positioning pin 301 after inserting the positioning pin 301 into the positioning though hole 35.

Similar to the first embodiment, the first opening 35A is formed in the vibration region 31 (thin portion) that is a vibrating portion of the diaphragm 30. The vibration region 31 (thin portion) is used (adopted) as the first layer 30A. Thus, a function of vibration (deformability) of the thin portion (vibration region 31) can be applied to deformation of the thin portion (vibration region 31) when the positioning pin is inserted into the positioning through hole 35.

The thickness of the second layer 30B of the diaphragm 30 is described below. As described in each of the above embodiments, the peripheral portion 30*a* of the first opening 35A of the first layer 30A is deformed into the second opening 35B of the second layer 30B.

Therefore, the thickness of the second layer 30B is made such that an inner end of the peripheral portion 30*a* of the first layer 30A does not protrude from an upper surface of the second layer 30B in FIG. 8C, that is, the inner end of the peripheral portion 30*a* of the first layer 30A does not protrude from a surface of the second layer 30B facing the common channel member 50 (see FIG. 2) to be bonded to the second layer 30B of the diaphragm 30 in the second embodiment.

The peripheral portion 30*a* protrudes from an inner end surface of the second opening 35B of the second layer 30B toward a center of the first opening 35A of the first layer 30A in the radial direction, and a length of the peripheral portion 30*a* in the radial direction is smaller than a thickness of the second layer 30B.

Next, the diaphragm 30 according to a third embodiment of the present disclosure is described with reference to FIGS. 9 and 10.

Figure 9:
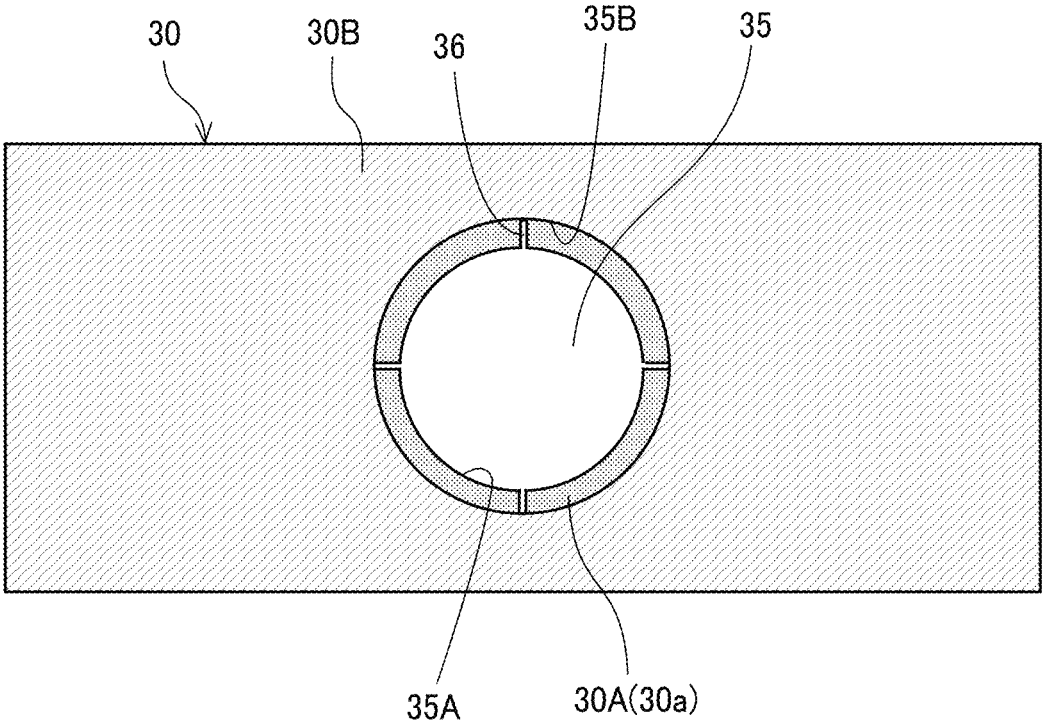
FIG. 9 is a schematic plan view of a portion of the positioning through hole of the diaphragm according to a third embodiment of the present disclosure.

FIG. 9 is a schematic plan view of a portion of the positioning through hole 35 of the diaphragm 30 according to the third embodiment.

Figure 10:
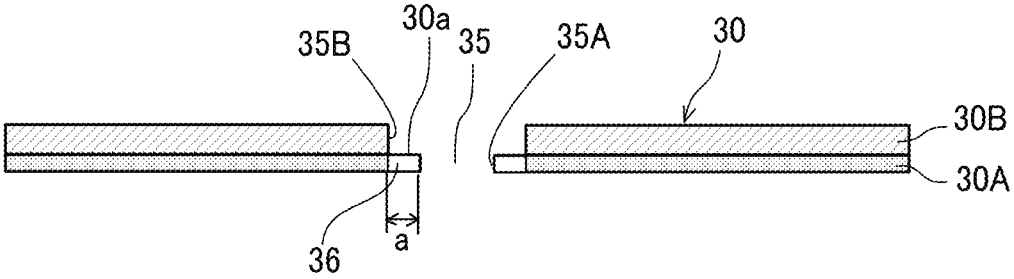
FIG. 10 is a schematic cross-sectional view of the positioning through hole in the diaphragm according to the third embodiment.

FIG. 10 is a schematic cross-sectional view of the positioning through holes 35 in the diaphragm 30 according to the third embodiment.

The diaphragm 30 according to the third embodiment includes cuts 36 in the peripheral portion 30*a* of the first opening 35A of the first layer 30A.

The cuts 36 are formed at four positions in the peripheral portion 30*a* around the circular first opening 35A at substantially equal intervals at about 90 degree. However, a number and spacing of the cut 36 are not limited to the embodiment as illustrated in FIG. 9.

Thus, the first layer 30A includes the cuts 36 around the peripheral portion 30*a* of the first opening 35A, and the cuts 36 are along a radial direction of the positioning through hole 35.

Further, a depth of the cut 36 in a radius direction of the first opening 35A is preferably within a region of the peripheral portion 30*a* (region "a" in FIG. 10) formed by only the first layer 30A. The region "a" is the peripheral portion 30*a* protruding toward a center of the first opening 35A of the first layer 30A from an inner end surface of the second opening 35B of the second layer 30B.

A length of the region "a" of the peripheral portion 30*a* is smaller than the thickness of the second layer 30B as illustrated in FIG. 8C.

With such a configuration of the diaphragm 30 as illustrated in FIGS. 9 and 10, the peripheral portion 30*a* of the first layer 30A is easily deformed when the positioning pin 301 is inserted into the positioning through hole 35 and the peripheral portion 30*a* of the first layer 30A is deformed toward the second opening 35B of the second layer 30B.

Further, deformation of the peripheral portion 30*a* of the first layer 30A in a circumferential direction of the first opening 35A becomes substantially uniform.

Thus, the diaphragm 30 according to the third embodiment can improve a positioning accuracy of the diaphragm 30.

Next, the diaphragm 30 according to a fourth embodiment of the present disclosure is described with reference to FIGS. 11(*a*) and 11(*b*).

Figure 11:
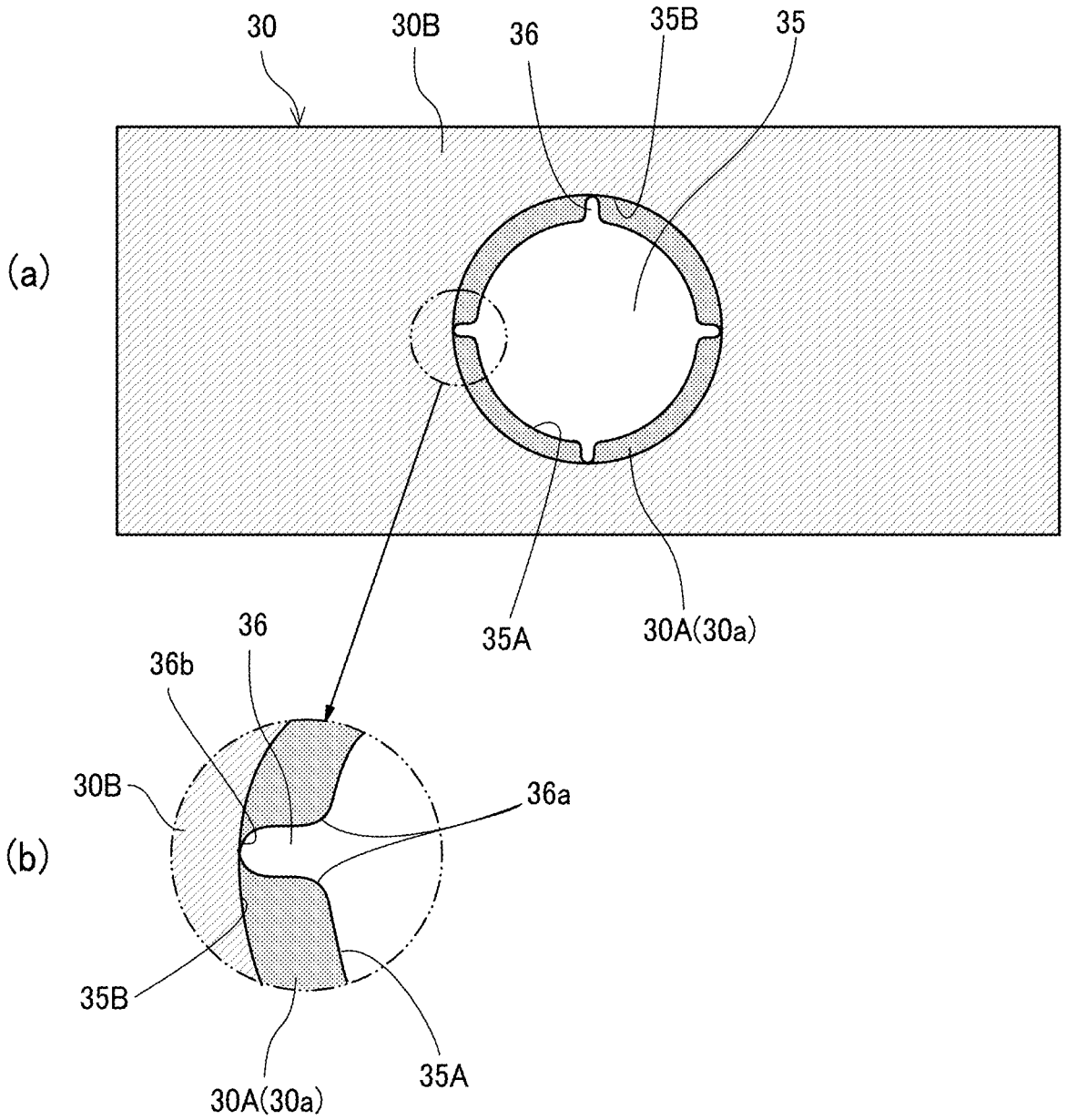
FIG. 11 is a schematic plan view of a portion of the positioning through hole of the diaphragm according to a fourth embodiment.

FIGS. 11(*a*) and 11(*b*) are schematic plan views of a portion of the positioning through hole 35 of the diaphragm 30 according to the fourth embodiment.

FIG. 11(*a*) is a schematic plan view of the positioning through hole 35 of the diaphragm 30 according to the fourth embodiment.

FIG. 11(*b*) is a partial enlarged plan view of the positioning through hole 35 of the diaphragm according to the fourth embodiment.

The diaphragm 30 according to the fourth embodiment includes cuts 36 having rounded corners 36*a* and 36*b*. Thus, the peripheral portion 30*a* of the first layer 30A includes cuts 36 having rounded corners 36*a* and 36*b*.

Thus, the diaphragm 30 can prevent the peripheral portion 30*a* of the first layer 30A from ripping from the corners 36*a* and 36*b* of the peripheral portions 30*a* when the peripheral portion 30*a* of the first opening 35A is deformed by inserting the positioning pin 301 into the positioning through hole 35.

Next, the diaphragm 30 according to a fifth embodiment of the present disclosure is described with reference to FIG. 12.

Figure 12:
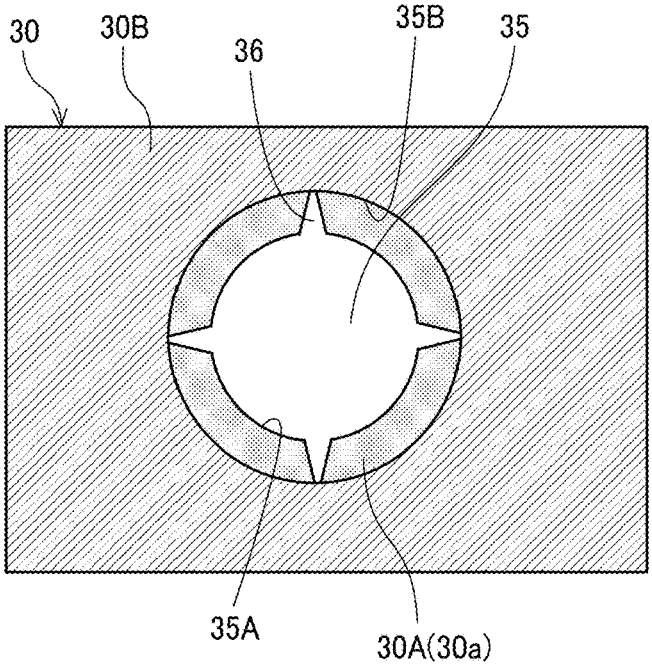
FIG. 12 is a schematic plan view of a portion of the positioning through hole of the diaphragm according to a fifth embodiment.

FIG. 12 is a schematic plan view of a portion of the positioning through hole 35 of the diaphragm 30 according to the fifth embodiment.

The diaphragm 30 according to the fifth embodiment includes cuts 36 having a shape that widens toward a center of the first opening 35A in an in-plane direction. In other words, the diaphragm 30 according to the fifth embodiment includes the peripheral portions 30*a* of the first opening 35A other than the cuts 36 having a shape that narrows toward the center of the first opening 35A in an in-plane direction.

With such a configuration of the diaphragm 30 as illustrated in FIG. 12, the peripheral portion 30*a* of the first opening 35A of the first layer 30A is easily deformed by an insertion the positioning pin 301 into the positioning through hole 35. Further, the deformation of the peripheral portion 30*a* of the first layer 30A in a circumferential direction of the first opening 35A becomes substantially uniform.

Next, the diaphragm 30 according to a sixth embodiment of the present disclosure is described with reference to FIG. 13.

Figure 13:
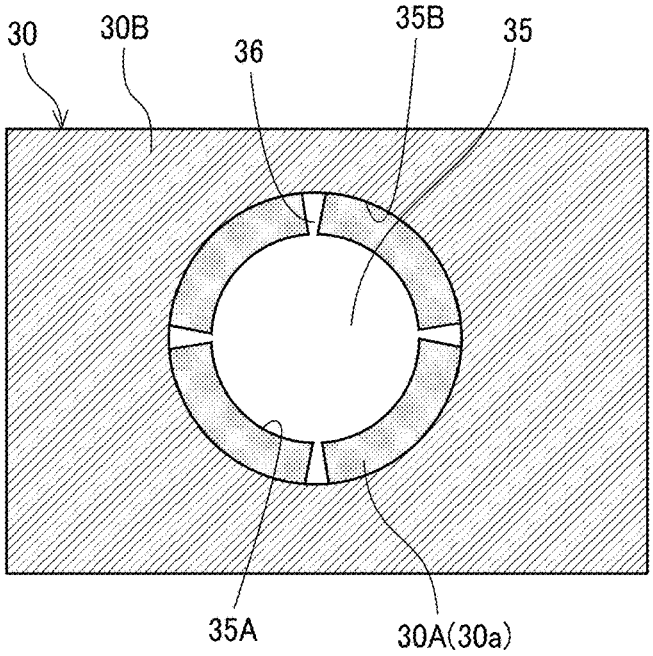
FIG. 13 is a schematic plan view of a portion of the positioning through hole of the diaphragm according to a sixth embodiment.

FIG. 13 is a schematic plan view of a portion of the positioning through hole 35 of the diaphragm 30 according to the sixth embodiment.

The diaphragm 30 according to the sixth embodiment includes a cut 36 having a shape that narrows toward the center of the first opening 35A in the in-plane direction. In other words, the diaphragm 30 according to the fifth embodiment includes the peripheral portions 30*a* of the first opening 35A other than the cuts 36 having a shape that widens toward the center of the first opening 35A in the in-plane direction.

With such a configuration of the diaphragm 30 as illustrated in FIG. 13, the peripheral portion 30*a* of the first opening 35A of the first layer 30A is easily deformed by an insertion the positioning pin 301 into the positioning through hole 35. Further, the deformation of the peripheral portion 30*a* of the first layer 30A in a circumferential direction of the first opening 35A becomes substantially uniform.

In each of the above embodiments, the diaphragm 30 having a two-layer structure is described as an example. However, the diaphragm 30 may have a three-layer structure. In the three-layer structure as well, the above embodiments may be applied such that a first layer of the diaphragm 30 on the channel plate 20 side is used as the first layer 30A, and the second and third layers may be used the second layer 30B and a third layer, respectively.

Further, application of the thin film member is not limited to the diaphragm 30 and can be similarly applied to the nozzle plate 10 and the channel plate 20 having a multi-layer structure. Further, the above embodiments can be combined with each other as long as there is no contradiction.

Next, an example of a printer 500 serving as a liquid discharge apparatus according to a seventh embodiment is described with reference to FIGS. 14 and 15.

Figure 14:
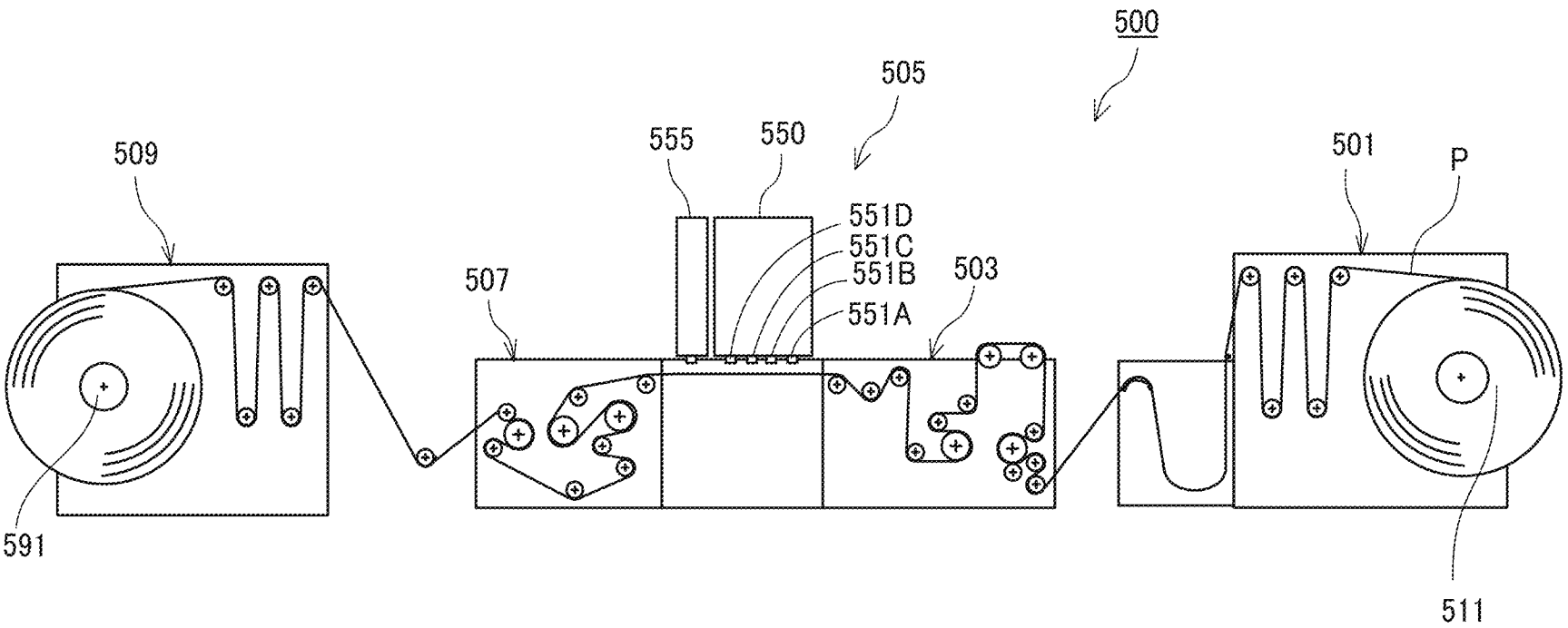
FIG. 14 is a schematic front view of a printer as a liquid discharge apparatus according to a seventh embodiment of the present disclosure.

FIG. 14 is a side view of the printer 500 as the liquid discharge apparatus according to the seventh embodiment of the present disclosure.

Figure 15:
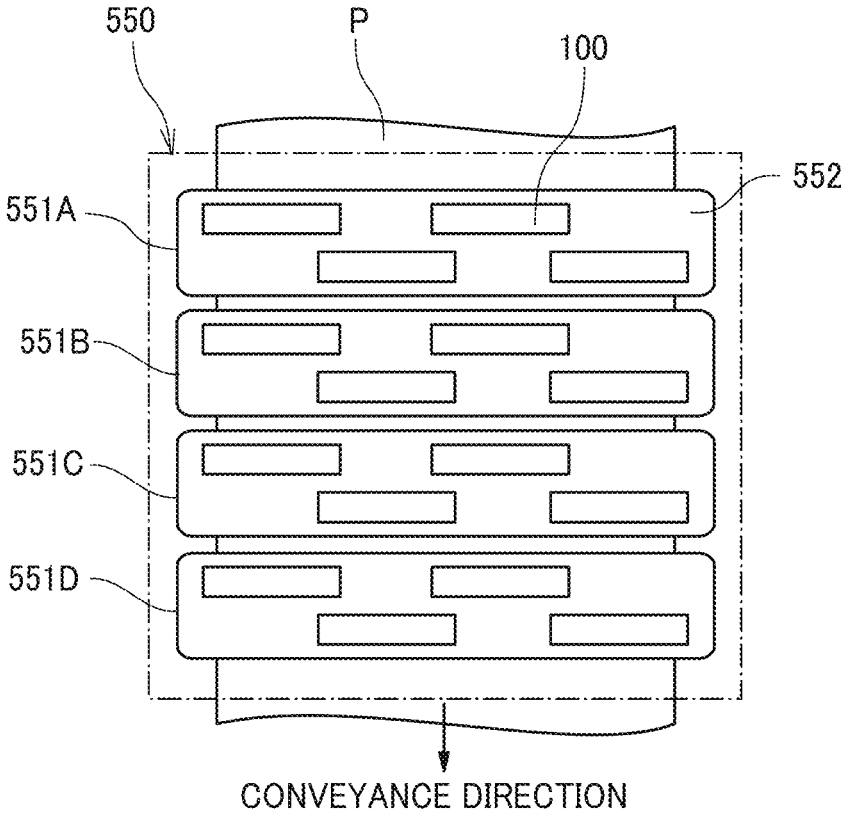
FIG. 15 is a plan view of an example of a liquid discharge device of the liquid discharge apparatus of FIG. 14.

FIG. 15 is a plan view of a head unit of the printer 500 as the liquid discharge apparatus of FIG. 14 according to the seventh embodiment.

The printer 500 is the liquid discharge apparatus including the head 100 to discharge a liquid on a medium such as a sheet P to form an image on the medium.

The printer 500 includes a loading device 501, a guide conveyor 503, a printing device 505, a drying device 507, and an ejection device 509.

The loading device 501 loads a web-like sheet P. The guide conveyor 503 guides and conveys the sheet P loaded by the loading device 501 to the printing device 505. The printing device 505 discharge a liquid onto the sheet P to form an image on the sheet P as a printing process. The drying device 507 dries the sheet P on which an image is formed by the printing device 505. The ejection device 509 ejects the sheet P conveyed from the drying device 507.

The sheet P is fed from a winding roller 511 of the loading device 501, guided and conveyed with rollers of the loading device 501, the guide conveyor 503, the drying device 507, and the ejection device 509, and wound around a take-up roller 591 of the ejection device 509.

In the printing device 505, the sheet P is conveyed so as to face the head device 550 and the head device 555 as a discharge device. The head device 550 discharges the liquid onto the sheet P to form an image on the sheet P. The head device 555 discharges a treatment liquid onto the sheet P, on which an image is formed by the head device 550, to perform a post-treatment process.

The head device 550 includes, for example, four-color full-line head arrays 551A, 551B, 551C, and 551D from an upstream side in a conveyance direction (see FIG. 15) of the sheet P from right to left in FIG. 14. Hereinafter, the four-color full-line head arrays 551A, 551B, 551C, and 551D are collectively referred to as "head arrays 551" unless colors are distinguished.

Each of the head arrays 551 is a liquid discharge device to discharge liquid of black (K), cyan (C), magenta (M), and yellow (Y) onto the sheet P conveyed in the conveyance direction of the sheet P as a continuous medium such as a web. Note that number and types of color are not limited to the above-described four colors of K, C, M, and Y and may be any other suitable number and types.

In the head array 551, for example, the heads 100 according to above-described embodiments of the present disclosure are arranged in a staggered manner on a base 552. Note that embodiments of the present disclosure are not limited to the arrangement and may be any other suitable head arrangement.

Next, another example of a printer 500 serving as a liquid discharge apparatus according to an eighth embodiment of the present disclosure is described with reference to FIGS. 16 and 17.

Figure 16:
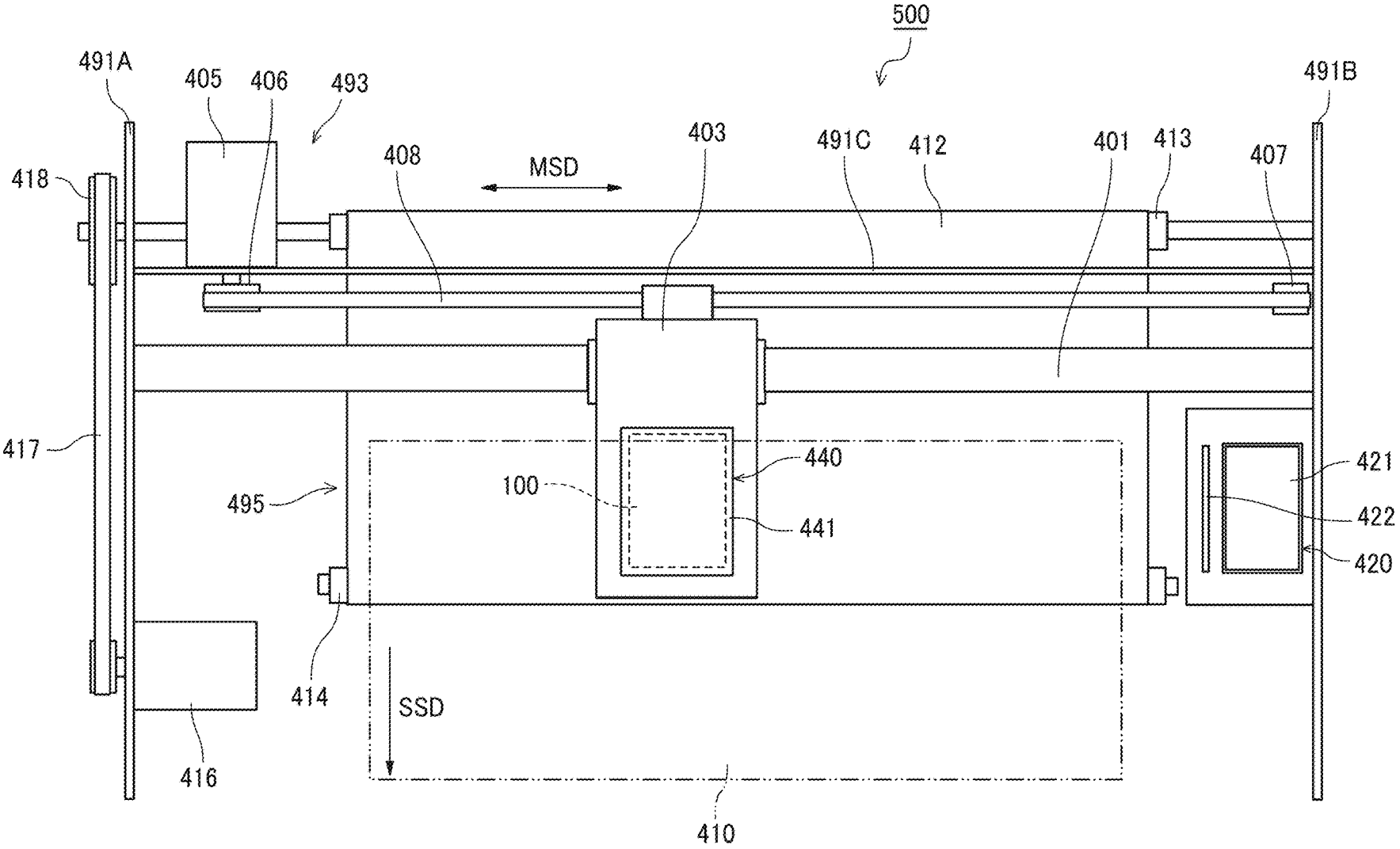
FIG. 16 is a plan view of a main part of a liquid discharge apparatus according to an eighth embodiment of the present disclosure.

FIG. 16 is a plan view of a portion of the printer 500.

Figure 17:
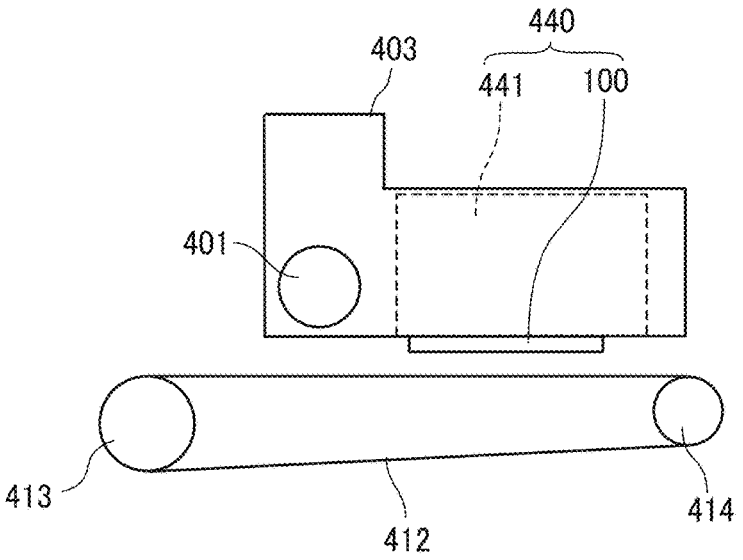
FIG. 17 is a schematic side view of a main portion of the liquid discharge apparatus.

FIG. 17 is a side view of a portion of the printer 500 of FIG. 16.

The printer 500 is a serial type apparatus, and a carriage 403 is reciprocally moved in a main scanning direction indicated by arrow "MSD" by a main scan moving unit 493. The main scan moving unit 493 includes, e.g., a guide 401, a main scan motor 405, and a timing belt 408. The guide 401 is bridged between left side plate 491A and the right side plate 491B to moveably hold the carriage 403. The main scan motor 405 reciprocally moves the carriage 403 in the main scanning direction MSD via the timing belt 408 bridged between a drive pulley 406 and a driven pulley 407.

The carriage 403 mounts a liquid discharge device 440. The head 100 and a head tank 441 forms the liquid discharge device 440 as a single unit. The head 100 has a configuration of one of the head 100 illustrated in FIGS. 1 to 12. The head 100 of the liquid discharge device 440 discharges color liquids of, for example, yellow (Y), cyan (C), magenta (M), and black (K). The head 100 includes a nozzle array including the plurality of nozzles 11 arrayed in row in a sub scanning direction indicated by arrow "SSD" perpendicular to the main scanning direction MSD in FIG. 16. The head 100 is mounted to the carriage 403 so that ink droplets are discharged downward from the nozzles 11.

The head 100 is connected to a liquid circulation device so that a liquid of a required color is circulated and supplied.

The printer 500 includes a conveyor 495 to convey a sheet 410. The conveyor 495 includes a conveyance belt 412 as a conveyor and a sub scan motor 416 to drive the conveyance belt 412.

The conveyance belt 412 attracts the sheet 410 and conveys the sheet 410 at a position facing the head 100. The conveyance belt 412 is an endless belt stretched between a conveyance roller 413 and a tension roller 414. Attraction of the sheet 410 to the conveyance belt 412 may be applied by electrostatic adsorption, air suction, or the like.

The conveyance belt 412 rotates in the sub scanning direction SSD as the conveyance roller 413 is rotationally driven by the sub scan motor 416 via the timing belt 417 and the timing pulley 418.

At one side in the main scanning direction MSD of the carriage 403, a maintenance unit 420 to maintain the head 100 in good condition is disposed on a lateral side of the conveyance belt 412.

The maintenance unit 420 includes, for example, a cap 421 to cap a nozzle surface of the head 100, a wiper 422 to wipe the nozzle surface, and the like. The nozzle surface is an outer surface of the nozzle plate 10 on which the nozzles 11 are formed.

The main scan moving unit 493, the maintenance unit 420, and the conveyor 495 are mounted to a housing that includes a left side plate 491A, a right side plate 491B, and a rear side plate 491C.

In the printer 500 thus configured, the sheet 410 is conveyed on and attracted to the conveyance belt 412 and is conveyed in the sub scanning direction SSD by the cyclic rotation of the conveyance belt 412.

The head 100 is driven in response to image signals while the carriage 403 moves in the main scanning direction MSD, to discharge liquid to the sheet 410 stopped, thus forming an image on the sheet 410.

Next, the liquid discharge device 440 according to a ninth embodiment of the present disclosure is described with reference to FIG. 18.

Figure 18:
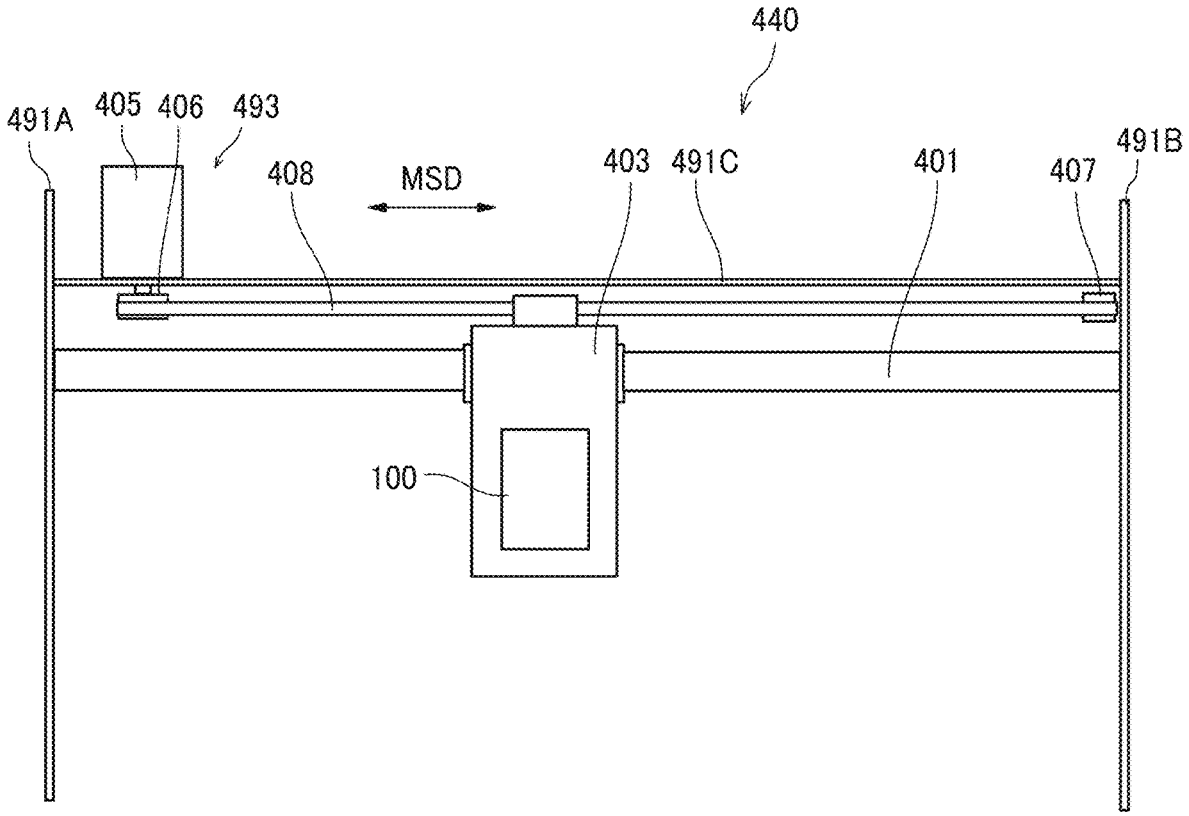
FIG. 18 is a plan view of a main part of a discharge device according to a ninth embodiment of the present disclosure.

FIG. 18 is a plan view of a portion of the liquid discharge device 440 according to the ninth embodiment of the present disclosure.

The liquid discharge device 440 includes a housing, the main scan moving unit 493, the carriage 403, and the head 100 among components of the printer 500 in FIG. 16. The left side plate 491A, the right side plate 491B, and the rear side plate 491C constitute the housing.

Note that, in the liquid discharge device 440, the maintenance unit 420 described above may be mounted on, for example, the right side plate 491B.

Next, still another example of the liquid discharge device 440 according to the present embodiment is described with reference to FIG. 19.

Figure 19:
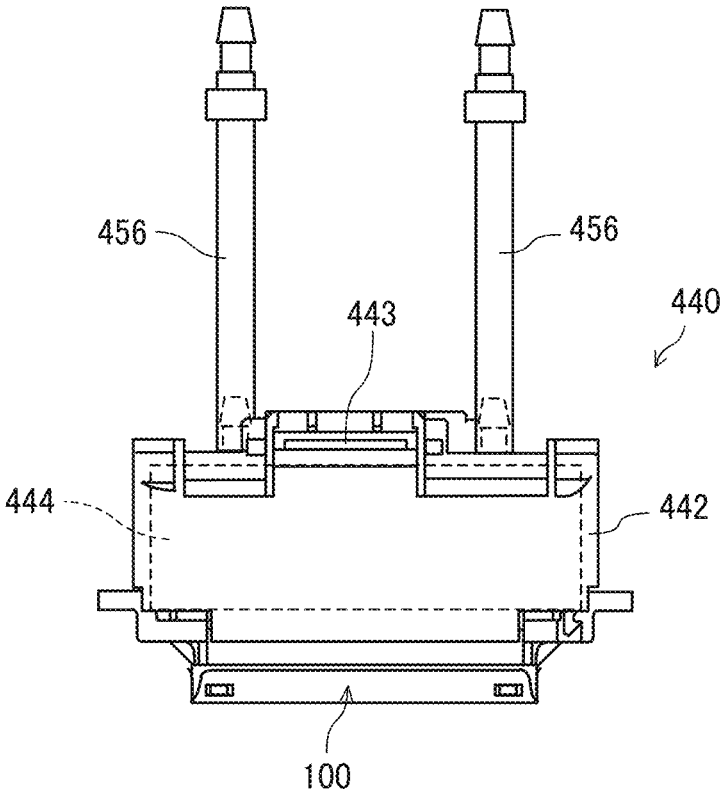
FIG. 19 is a front view of a discharge device according to a tenth embodiment of the present disclosure.

FIG. 19 is a schematic front view of still another example of the liquid discharge device 440.

The liquid discharge device 440 includes the head 100 to which a channel part 444 is attached, and a tube 456 connected to the channel part 444.

Further, the channel part 444 is disposed inside a cover 442. In some embodiments, the liquid discharge device 440 may include the head tank 441 described above instead of the channel part 444. A connector 443 electrically connected with the head 100 is provided on an upper part of the channel part 444.

In the present embodiments, a "liquid" discharged from the head is not particularly limited as long as the liquid has a viscosity and surface tension of degrees dischargeable from the head.

However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or unit(s) combined to the head to form a single unit. For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head of the liquid discharge device.

In another example, the head and the carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms a part of a maintenance unit may be secured to the carriage mounting the head so that the head, the carriage, and the maintenance unit form a single unit to form the liquid discharge device.

Further, in another example, the liquid discharge device includes tubes connected to the head mounting the head tank or the channel part so that the head and a supply unit form a single unit. Liquid is supplied from a liquid reservoir source to the head via the tube.

The main scan moving unit may be a guide only. The supply unit may be a tube(s) only or a loading unit only.

The term "liquid discharge apparatus" used herein also represents an apparatus including the head or the liquid discharge device to drive the head to discharge liquid. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate. Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell. The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material on which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head configured to discharge a liquid, the liquid discharge head comprising:

a thin film member including:

a first layer;

a second layer bonded with the first layer; and a through hole penetrating through the first layer and the second layer, wherein the through hole includes a first opening in the first layer and a second opening in the second layer, the first layer includes a peripheral portion in a periphery of the first opening of the first layer, the peripheral portion not overlapping with the second layer in a plan view, the peripheral portion is deformable inside the second opening of the second layer, and the peripheral portion does not protrude from a first surface of the second layer opposite to a second surface of the second layer bonded to the first layer when the peripheral portion is deformed.

2. A discharge device according to claim 1, wherein the through hole is circular, and a diameter of the second opening is larger than a diameter of the first opening.

3. The liquid discharge head according to claim 1, wherein the peripheral portion of the first layer includes cuts around the first opening, and the cuts are along a radial direction of the through hole.

4. The liquid discharge head according to claim 1, wherein a thickness of the first layer is smaller than a thickness of the second layer.

5. The liquid discharge head according to claim 1, further comprising:

a nozzle from which the liquid is discharged;

a pressure chamber communicating with the nozzle; and a diaphragm including a vibration region configured to define a wall of the pressure chamber, wherein the diaphragm includes the thin film member, and the vibration region includes the first layer of the thin film member.

6. The liquid discharge head according to claim 5 further comprising:

a piezoelectric element bonded to the diaphragm, wherein the first layer of the thin film member faces the pressure chamber, and the second layer of the thin film member is bonded to the piezoelectric element.

7. The liquid discharge head according to claim 3, wherein the cuts are around the first opening at equal intervals.

8. The liquid discharge head according to claim 3, wherein the cuts have rounded corners.

9. The liquid discharge head according to claim 3, wherein the cuts have a shape that widens toward a center of the first opening in an in-plane direction.

10. The liquid discharge head according to claim 3, wherein the cuts have a shape that narrows toward a center of the first opening in an in-plane direction.

11. The liquid discharge head according to claim 3, wherein the peripheral portion protrudes from an inner end surface of the second opening of the second layer toward a center of the first opening of the first layer in the radial direction, and a length of the peripheral portion in the radial direction is smaller than a thickness of the second layer.

12. A discharge device comprising:

the liquid discharge head according to claim 1.

13. A liquid discharge apparatus comprising:

the discharge device according to claim 12.

* * * * *